US006739702B2

(12) United States Patent
Sakuma

(10) Patent No.: US 6,739,702 B2
(45) Date of Patent: May 25, 2004

(54) HEAD CHIP

(75) Inventor: Katsuhisa Sakuma, Chiba (JP)

(73) Assignee: SII Printer Inc., Chiba (JP)

( * ) Notice: Subject to any disclaimer, the term of this patent is extended or adjusted under 35 U.S.C. 154(b) by 0 days.

(21) Appl. No.: 10/261,608

(22) Filed: Sep. 30, 2002

(65) Prior Publication Data

US 2003/0090551 A1 May 15, 2003

(30) Foreign Application Priority Data

Nov. 15, 2001 (JP) ..... 2001-350649

(51) Int. Cl.[7] ..... B41J 2/045
(52) U.S. Cl. ..... 347/68
(58) Field of Search ..... 347/68–71, 65, 347/63

(56) References Cited

U.S. PATENT DOCUMENTS 5,625,393 A 4/1997 Asai ..... 347/69
2002/0167568 A1 * 11/2002 Sakuma ..... 347/68
2003/0063164 A1 * 4/2003 Sakuma ..... 347/68

FOREIGN PATENT DOCUMENTS

EP 1236573 9/2002

* cited by examiner

*Primary Examiner*—Judy Nguyen
(74) *Attorney, Agent, or Firm*—Adams & Wilks

(57) ABSTRACT

A head chip has a substrate, a chamber formed in the substrate for containing ink and an end portion communicating with a nozzle opening, and an electrode disposed on a sidewall of the chamber. The chamber has an end portion communicating with a nozzle opening. When a driving voltage is applied to the electrode, a capacity within the chamber is varied to discharge ink contained in the chamber from the nozzle opening. An ink chamber plate is connected to the substrate and defines a common ink chamber communicating with the chamber. The common ink chamber has a partitioning portion for partitioning the chamber and the common ink chamber. The partitioning portion has communicating holes that evenly divide a chamber longitudinal direction of the partitioning portion using a distance between the nozzle opening and a communicating hole establishing communication between the common ink chamber and the chamber.

28 Claims, 7 Drawing Sheets

FIG.16 APRIOR ART
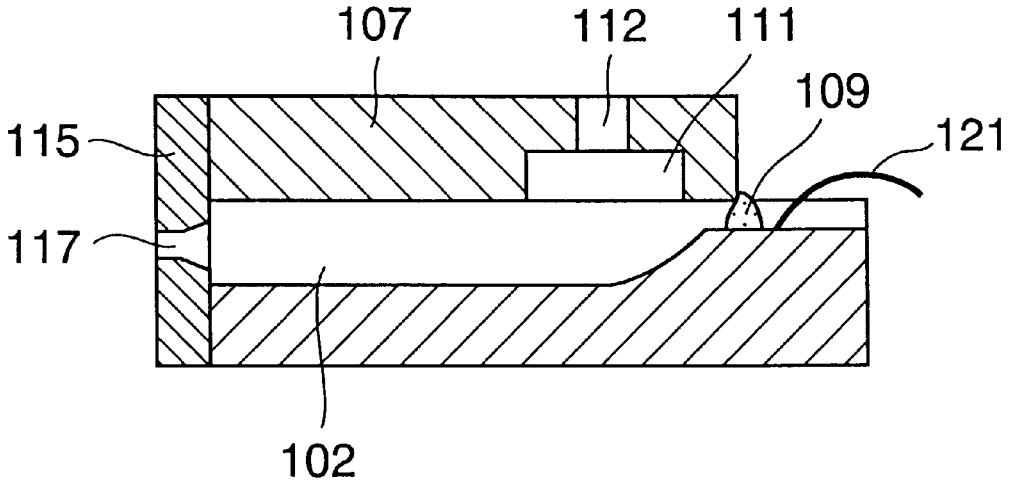
FIG.16B PRIOR ART
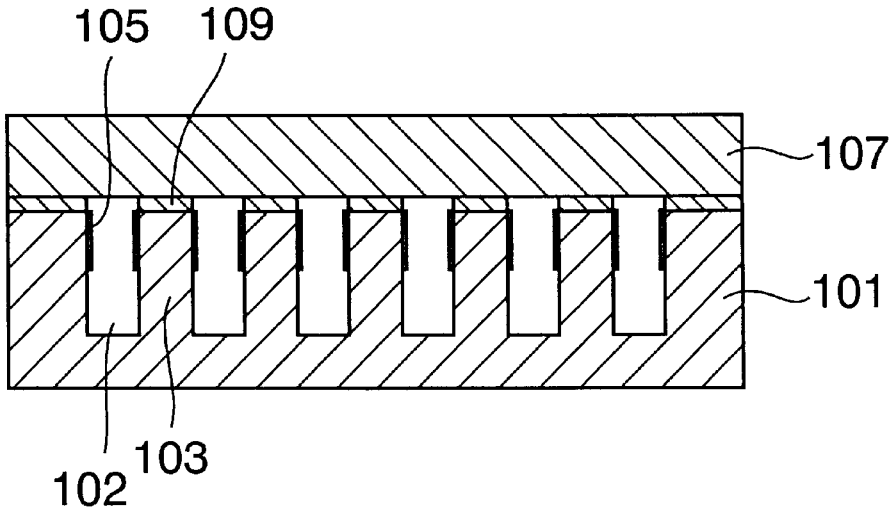

HEAD CHIP

BACKGROUND OF THE INVENTION

1. Field of the Invention

The present invention relates to a head chip that is mounted on an ink jet recording device applied to, for example, a printer or a facsimile.

2. Description of the Related Art

Conventionally, there is known an ink jet recording device that records characters and images on a medium to be recorded using an ink jet head having a plurality of nozzles for discharging ink. In such an ink jet recording device, the nozzles of the ink jet head are provided in a head holder so as to oppose the medium to be recorded, and this head holder is mounted on a carriage to be scanned in a direction perpendicular to a conveying direction of the medium to be recorded.

A sectional view in the longitudinal direction of an example of a head chip of such an ink jet head is shown in FIG. 16A and a sectional view of a main portion of the same is shown in FIG. 16B. As shown in FIGS. 16A and 16B, a plurality of grooves 102 are provided in parallel with each other in a piezoelectric ceramic plate 101, and each groove 102 is separated by sidewalls 103. An end portion in the longitudinal direction of each groove 102 is extended to an end surface of the piezoelectric ceramic plate 101 and the other end portion is not extended to the other end surface, making the groove 102 to be gradually shallow. In addition, electrodes 105 for applying a driving electric field are formed on surfaces on opening side of both sidewalls 103 in each groove 102 throughout its longitudinal direction.

In addition, a cover plate 107 is joined on the opening side of the grooves 102 of the piezoelectric ceramic plate 101 via a partitioning portion using an adhesive 109. The cover plate 107 includes a common ink chamber 111 in the form of a recessed portion communicating with each groove 102 via communication holes provided in the partitioning portion in the longitudinal direction of the respective grooves 102 and an ink supply port 112 that is bored from the bottom portion of the common ink chamber 111 in the direction opposite to the grooves 102.

In addition, a nozzle plate 115 is joined to an end surface of the joined body of the piezoelectric ceramic plate 101, the partitioning portion and the cover plate 107 in which the grooves 102 are opened, and nozzle openings 117 are formed in the nozzle plate 115 at positions opposing the respective grooves 102.

Further, a wiring substrate is fixed to the surface of the piezoelectric ceramic plate 101 on the opposite side of the nozzle plate 115 and on the opposite side of the cover plate 107. Wiring connected to each electrode 105 via bonding wires 121 or the like is formed on the wiring substrate, and a driving voltage can be applied to the electrodes 105 via the wiring.

In a head chip configured in this way, when each groove 102 is filled with ink from the ink supply port 112 and a predetermined driving electric field is caused to act on the sidewalls 103 on both sides of the predetermined groove 102 via the electrode 105, the sidewalls 103 are deformed to change the capacity inside the predetermined groove 102, whereby the ink in the groove 102 is discharged from the nozzle opening 117.

For example, as shown in FIG. 17, if ink is discharged from the nozzle opening 117 corresponding to a groove 102*a*, a positive driving voltage is applied to electrodes 105*a* and 105*b* in the groove 102*a* and, at the same time, opposing electrodes 105*c* and 105*d* to the respective electrodes are grounded. Consequently, a driving electric field in the direction toward the groove 102*a* acts on sidewalls 103*a* and 103*b* and, if the driving electric field is perpendicular to a direction of polarization of the piezoelectric ceramic plate 101, the sidewalls 103*a* and 103*b* are deformed in the direction of the groove 102*a* by a piezoelectric thickness slip effect and the capacity inside the groove 102*a* decreases to increase pressure, whereby the ink is discharged from the nozzle opening 117.

As a measure for solving a problem that it is difficult to achieve high speed consecutive discharging, that is, to achieve high speed printing in a head chip like this, the degree of sealing of a chamber is increased for the sake of shortening a time from the stoppage of vibration of the sidewalls caused by ink discharging to the obtainment of a situation where pressure of ink in the chamber corresponding to the groove becomes zero to perform the next ink discharging, although this time varies depending on the length of the chamber, the shape of the nozzle opening, and the like. However, if the opening area of the communicating hole is narrowed too much for the sake of enhancing the degree of sealing of the chamber, there occurs a problem that ink necessary for discharging is not sufficiently supplied from the common ink chamber to the chamber and printing is not normally performed.

SUMMARY OF THE INVENTION

In view of such circumstances, it is an object of the present invention is to provide a head chip in which the minimum size of the communicating hole, with which it is possible to sufficiently supply ink necessary for discharging and, at the same time, to enhance the degree of sealing of the chamber to a limit, is defined with reference to the length in the longitudinal direction of the chamber.

In order to solve the above-mentioned object, according to a first aspect of the present invention, a head chip includes: a chamber that is defined on a substrate and has an end portion in a longitudinal direction that communicates with a nozzle opening; and an electrode provided on a sidewall of the chamber, in which a driving voltage is applied to the electrode so that a capacity within the chamber is changed to discharge ink filled therein from the nozzle opening. The head chip is characterized in that: an ink chamber plate defining a common ink chamber communicating with the chamber is joined on the substrate; the common ink chamber is provided with a partitioning portion for partitioning the chamber and the common ink chamber; the partitioning portion is provided with a plurality of communicating holes that evenly divide a chamber longitudinal direction of the partitioning portion using a distance between the nozzle opening and a communicating hole establishing communication between the common ink chamber and the chamber and which is provided in the partitioning portion at a position close to the nozzle opening, and each of the plurality of communicating holes has the same opening ratio to an area of the partitioning portion; and if a length in the longitudinal direction of the chamber is referred to as Y (mm) and an opening ratio of each communicating hole to the area of the partitioning portion is referred to as X (%), when a size of the communicating hole satisfying a relation of "Y=−4.5X+15.8" is referred to as $S_{min}$ and a size of a communicating hole obtained by coupling the plurality of communicating holes to each other is referred to as $S_{max}$, there is obtained a relation of $S_{min}$ size of communicating hole<$S_{max}$.

According to a second aspect of the present invention, in the first aspect of the invention, a head chip is characterized in that the partitioning portion is formed of a separate member.

According to a third aspect of the present invention, in the first or the second aspect of the invention, a head chip is characterized in that the substrate is formed of a piezoelectric ceramic plate, and the chamber is defined by forming a groove in the piezoelectric ceramic plate.

According to a fourth aspect of the present invention, in the first or the second aspect of the invention, a head chip is characterized in that the sidewalls are made of piezoelectric ceramic and are arranged on the substrate at a predetermined interval, and the chamber is defined between the sidewalls.

According to a fifth aspect of the present invention, in the fourth aspect of the invention, a head chip is characterized in that the sidewalls are made of piezoelectric ceramic and are arranged on the substrate at a predetermined interval, and the chamber is defined between the sidewalls, and that the common ink chamber is defined on the substrate, and the chamber and the common ink chamber communicate with each other at one end in the longitudinal direction of the chamber.

In the present invention, the minimum size of the communicating hole, with which it is possible to sufficiently supply ink necessary for discharging and, at the same time, to enhance the degree of sealing of the chamber to a limit, is defined with reference to the length in the longitudinal direction of the chamber. Therefore, it becomes possible to shorten the converging time, during which pressure in the chamber attenuates, without causing the deterioration of an ink supply property and an ink discharging property. As a result, it becomes possible to achieve high speed printing by consecutively discharging ink at high speed.

BRIEF DESCRIPTION OF THE DRAWINGS

For a more better understanding of the present invention, reference is made of a detailed description to be read in conjunction with the accompanying drawings, in which:

FIG. 16A is a sectional view in the longitudinal direction showing an outline of a head chip according to the prior art;

FIG. 16B is a sectional view showing an outline of a main portion of the head chip according to the prior art.

DETAILED DESCRIPTION OF THE PREFERRED EMBODIMENT

The present invention will be described in detail below based on embodiment modes of the present invention.

Figure 1:
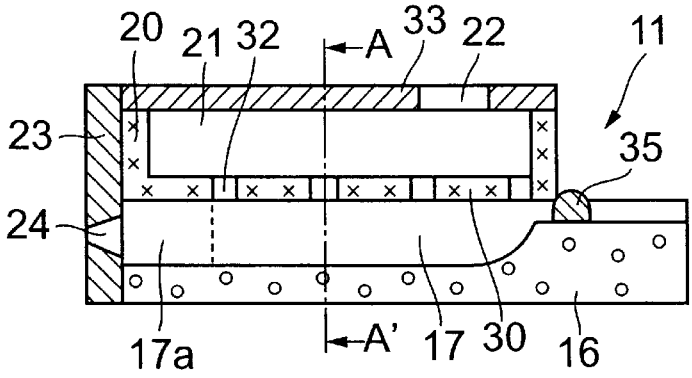
FIG. 1 is a sectional view in the longitudinal direction of a head chip according to first or third embodiment of the present invention.
Figure 2:
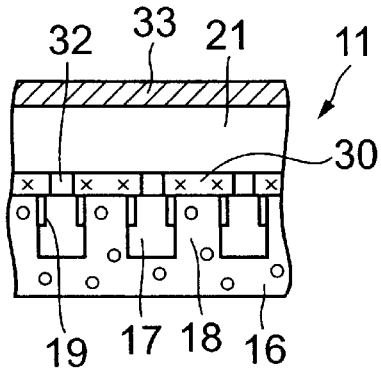
FIG. 2 is a sectional view cut along the line 2—2 of FIG. 1.

FIG. 1 is a sectional view in the longitudinal direction of a chamber of a head chip, while FIG. 2 is sectional view cut along a line 2—2 of FIG. 1. These drawings show a first or third embodiment mode.

First, the head chip 11 will be described in detail. As shown in FIGS. 1 and 2, chambers 17 consisting of a plurality of grooves or channels are provided in parallel with each other in a piezoelectric ceramic plate 16 constituting the head chip 11, and each chamber 17 is separated by sidewalls 18. One end portion in the longitudinal direction of each chamber 17 extends to one end surface of the piezoelectric ceramic plate 16 and the other end portion does not extend to the other end surface, making the groove to be gradually shallow. In addition, electrodes 19 for applying a driving electric field are formed on surfaces on opening side of both the sidewalls 18 in each chamber 17 throughout its longitudinal direction.

Here, each chamber 17 formed on the piezoelectric ceramic plate 16 is formed by, for example, a dice cutter of a disk shape, and the portion where the groove is made to be gradually shallow is formed according to a shape of the dice cutter. In addition, the electrodes 19 formed in each chamber 17 are formed by, for example, publicly-known evaporation from a diagonal direction.

An ink chamber plate 20 is joined to the opening side of the chamber 17 of the piezoelectric ceramic plate 16 via adhesive 35. This ink chamber plate 20 includes a common ink chamber 21 to be a recessed portion communicating with each chamber 17 and the common ink chamber 21 is sealed with a common ink chamber lid 33 having an ink supply port 22 communicating with this common ink chamber. It is possible to form the ink chamber plate 20 using a ceramic plate, a metallic plate, or the like, although it is preferable to use a ceramic plate having a close coefficient of thermal expansion if consideration is given to deformation and the like after the joining with the piezoelectric ceramic plate 16.

The ink chamber plate 20 like this is provided with a partitioning portion 30 that is provided with a plurality of communicating holes 32 that establish communication between the chamber 17 and the common ink chamber 21 and are arranged in the longitudinal direction of the chamber 17 at regular intervals so as to pass through the partitioning portion in the thickness direction.

With this construction, the intervals between respective communicating holes 32, that is, a distance from the communicating hole 32 positioned close to the nozzle opening 24 to the nozzle opening 24 is set as a pump portion 17*a* and a length thereof becomes a pump length of the head chip 11. Converging time, during which pressure attenuates, is determined by the pump length. Here, the pressure is generated by the repetitive reflection of sound pressure in the chamber 17 when vibration of sidewalls 18 stops after ink discharging. Consequently, it becomes possible to easily define the length of the pump portion 17*a* by the position (number) of the communicating hole 32 and to shorten the converging time.

It should be noted here that no specific limitation is imposed on the number of such communicating holes 32 and it is possible to arrange communicating holes whose number is within a range in which there is exerted no influence on a discharging capability. Further, in order to prevent a bubble from staying in an end portion where the chamber 17 is made shallow, the communicating hole 32 is provided at a position opposing the end portion.

In addition, a nozzle plate 23 is joined to an end surface of the joined body of the piezoelectric ceramic plate 16 and the ink chamber plate 20 in which the chambers 17 are opened, and a nozzle opening 24 is formed in the nozzle plate 23 at a position opposing each chamber 17.

This nozzle plate 23 is produced by forming the nozzle opening 24 in a polyimide film or the like using, for instance, an excimer laser apparatus. Also, although not shown in the drawing, on a surface of the nozzle plate 23 opposing an object to be printed, there is provided a water-repellent film having water repellency in order to prevent the adhesion of ink or the like.

In addition, ink introduced from an unillustrated ink cartridge or ink pack passes through an unillustrated ink flow path, is filled into the common ink chamber 21 from the ink supply port 22, passes through each communicating hole 32, and is filled into each chamber 17.

In this case, if the length of the chamber 17 in the longitudinal direction is referred to as Y (mm) and the opening ratio of one communicating hole 32 to the area of the partitioning portion 30 for one chamber is referred to as X (%), the minimum area of the communicating hole is determined using an expression of "$Y=-4.5X+15.8$". In this manner, it becomes possible to circumvent the shortage of ink supply to the chamber. Here, in terms of the structure of the present head chip, needless to say, the maximum size of the communicating hole becomes a size where the plurality of communicating holes are coupled to each other.

It should be noted here that a head chip that uses insulating ink is described as an example in the embodiment mode described above, although a head chip that uses conductive ink, such as water ink, may be employed.

In the case where conductive ink, such as water ink, is used in a head chip in this manner, electrodes are subjected to conduction by the ink in the chambers 17, so that there occurs electrolysis of the ink and, at the same time, it becomes impossible to perform normal driving. In view of this problem, a chamber for discharging ink to a piezoelectric ceramic plate and a dummy chamber that is not filled with ink are alternately arranged to have the conductive ink discharged. In this case, the dummy chamber may be prevented from being filled with ink by a partitioning portion.

Even with a head chip that uses conductive ink in this manner, it is possible to obtain the same effect by providing a plurality of communicating holes 32 like in the case of the head chip 11 using the insulating ink described above in the partitioning portion for each chamber that discharges the ink.

Figure 3:
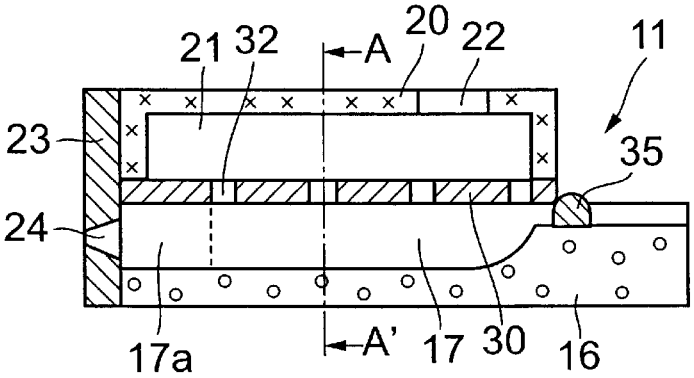
FIG. 3 is a sectional view in the longitudinal direction of a head chip according to second or third embodiment of the present invention.
Figure 4:
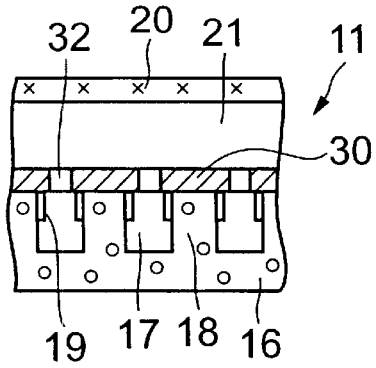
FIG. 4 is a sectional view cut along the line 4—4 of FIG. 3.

FIG. 3 is a sectional view in the longitudinal direction of a chamber of a head chip, while FIG. 4 is sectional view cut along the line 4—4 of FIG. 3. These drawings show a second or third embodiment mode.

The second or third embodiment mode differs from the first embodiment only in that there is not used the common ink chamber lid 33 provided with the ink supply port 22 communicating with the common ink chamber 21, the ink chamber plate 20 is not provided with the partitioning portion 30, and the partitioning portion 30 having the communicating holes 32 is made of a separate member. All other aspects are the same as those in the first embodiment mode.

The head chip 11 having a construction like this is obtained by first joining the piezoelectric ceramic plate 16 to the ink chamber plate 20 so that the partitioning portion 30 is nipped between them and then joining the nozzle plate 23 to an end surface of the joined body.

Even in the case of the head chip 11 like this, if the length of the chamber 17 in the longitudinal direction is referred to as Y (mm) and the opening ratio of one communicating hole 32 to the area of the partitioning portion 30 for one chamber is referred to as X (%), the minimum area of the communicating hole is determined using an expression of "$Y=-4.5X+5.8$". In this manner, it becomes possible to circumvent the shortage of ink supply to the chamber. Here, in terms of the structure of the present head chip, needless to say, the maximum size of the communicating hole becomes a size where the plurality of communicating holes are coupled to each other.

Also, it is possible to use conductive ink with the same method as in the first embodiment mode.

Figure 5:
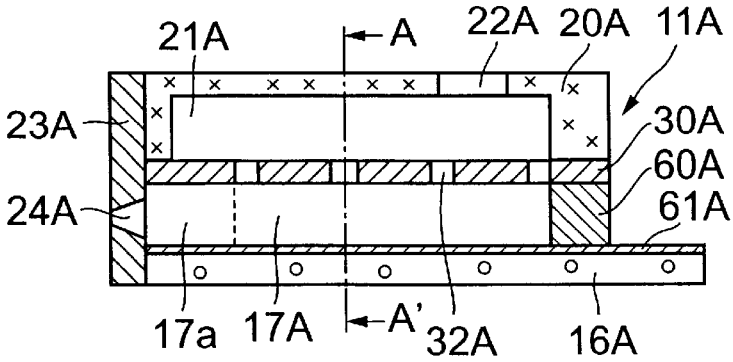
FIG. 5 is a sectional view in the longitudinal direction of a head chip according to one aspect of a fourth embodiment mode of the present invention.
Figure 6:
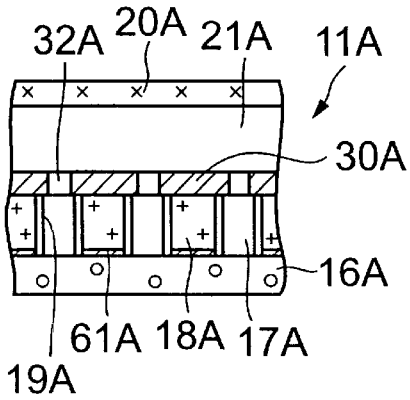
FIG. 6 is a sectional view cut along the line 6—6 of FIG. 5.

FIGS. 5 and 6 show a fourth embodiment mode of the present invention. FIG. 5 is a sectional view in the longitudinal direction of a head chip according to this embodiment mode, while FIG. 6 is a sectional view cut along the line 6—6 of FIG. 5.

As shown in the drawings, the head chip 11A has a construction where sidewalls 18A made of a piezoelectric ceramic are arranged on a substrate 16A at predetermined intervals and chambers 17A are defined between respective sidewalls 18A.

Also, a sealing plate 60A is provided on the substrate 16A and one end of the chamber 17A in the longitudinal direction is sealed with the sealing plate.

Also, the partitioning portion 30A exists between the chamber 17A and the common ink chamber 21A provided for the ink chamber plate 20A and a plurality of communicating holes 32A are established in the partitioning portion at predetermined regular intervals.

Further, electrodes 19A provided on both sidewalls 18A of the chambers 17A are provided over the entire surface of the sidewalls and the conduction between the electrodes and an unillustrated driving circuit is established by wiring 61A. For instance, the wiring 61A is extended along the chambers 17A defined on both sides between the substrate 16A and each sidewall 18A and surely contacts the electrodes 19A in both end portions in the width direction of the extended wiring 61A, whereby the conduction between the electrodes and the wiring is realized.

Even in the case of the head chip 11A like this, if the length of the chamber 17A in the longitudinal direction is referred to as Y (mm) and the opening ratio of one communicating hole 32A to the area of the partitioning portion 30A for one chamber is referred to as X (%), the minimum area of the communicating hole is determined using an expression of "Y=−4.5X+15.8". In this manner, it becomes possible to circumvent the shortage of ink supply to the chamber. Here, in terms of the structure of the present head chip, needless to say, the maximum size of the communicating hole becomes a size where the plurality of communicating holes are coupled to each other.

Also, it is possible to use conductive ink with the same method as in the first embodiment mode.

Further, the partitioning portion 30A is a separate member in this embodiment mode. However, needless to say, there occurs no problem even if there is obtained a construction where the ink chamber plate 20A is provided with the partition portion and the common ink chamber 21A is formed using the common ink chamber lid that is a separate member and includes the ink supply port 22A communicating with the common ink chamber.

Figure 7:
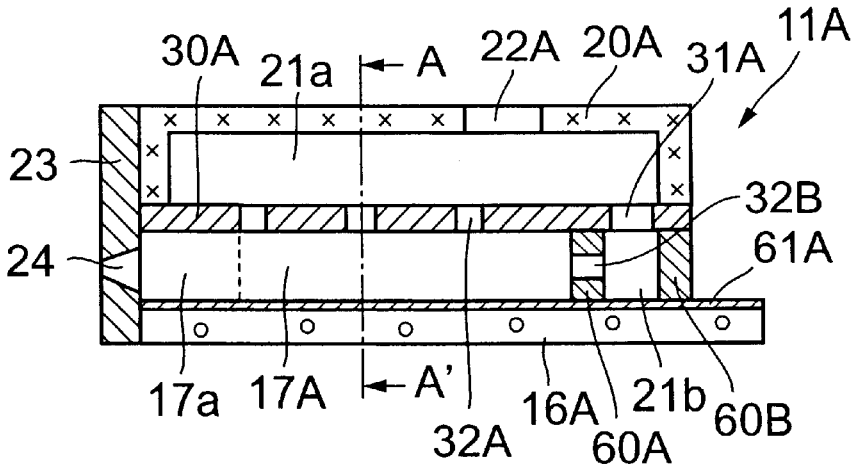
FIG. 7 is a sectional view in the longitudinal direction of a head chip according to one aspect of a fifth embodiment mode of the present invention.
Figure 8:
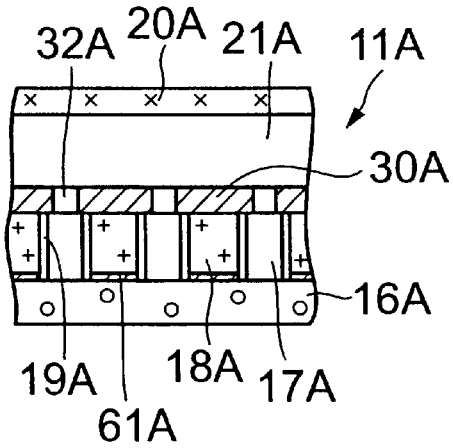
FIG. 8 is a sectional view cut along the line 8—8 of FIG. 7.

FIGS. 7 and 8 show a fifth embodiment mode of the present invention. FIG. 7 is a sectional view in the longitudinal direction of a head chip according to an embodiment mode, while FIG. 8 is a sectional view cut along the line 8—8 of FIG. 7.

The fifth embodiment mode differs from the fourth embodiment mode only in that a second sealing plate 60B exists outside of the sealing plate 60A, a communicating hole 32B having the same size as the communicating hole 32A is established in the sealing plate 60A at a position opposing the chamber 17A, the common ink chamber 21A provided on the ink chamber plate 20A is set as the first ink chamber 21*a*, a second ink chamber 21*b* is defined between the sealing plate and the second sealing plate, the communicating hole 32B establishes communication between the second ink chamber 21*b* and the chamber 17A, an ink supply communicating hole 31A for establishing communication between the first ink chamber 21*a* and the second ink chamber 21*b* is formed in the partitioning portion 30A, and the communicating hole 32A existing close to the sealing plate 60A is eliminated from the partitioning portion 30A. All other aspects are the same as those in the fourth embodiment mode.

Even in the case of the head chip 11A like this, if the length of the chamber 17A in the longitudinal direction is referred to as Y (mm) and the opening ratio of one communicating hole 32A to the area of the partitioning portion 30A for one chamber is referred to as X (%), the minimum area of the communicating hole is determined using an expression of "Y=−4.5X+15.8". In this manner, it becomes possible to circumvent the shortage of ink supply to the chamber. Here, in terms of the structure of the present head chip, needless to say, the maximum size of the communicating hole becomes a size where the plurality of communicating holes are coupled to each other.

Also, it is possible to use conductive ink by sealing the dummy chambers using the sealing plate 60A and concurrently using the same method as in the first embodiment mode.

Further, the partitioning portion 30A is a separate member in this embodiment mode. However, needless to say, there occurs no problem even if there is obtained a construction where the ink chamber plate 20A is provided with the partition portion and the common ink chamber 21A is formed using the common ink chamber lid that is a separate member and includes the ink supply port 22A communicating with the common ink chamber 21A.

Figure 9:
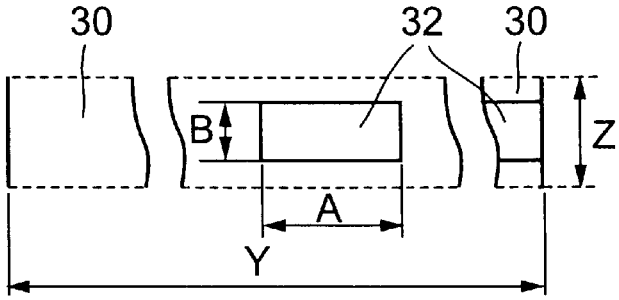
FIG. 9 is a plain view of a partitioning portion corresponding to one chamber of the head chip according to every embodiment mode of the present invention.

Finally, how to define the size of each communicating hole 32 or 32A will be described with reference to FIG. 9. FIG. 9 is a plain view of the partitioning portion 30 or 30A positioned on one chamber 17 or 17A and a plurality of communicating holes 32 or 32A of the partitioning portion.

It is assumed that the length of the chamber 17 or 17A in the longitudinal direction is referred to as Y (mm), the width of the chamber 17 or 17A is referred to as Z (mm), the length of a long side of one communicating hole 32 or 32A having a rectangular shape is referred to A (mm), and the length of a short side thereof is referred to as B (mm). Here, if the opening ratio of one communicating hole 32 or 32A to the area of the partitioning portion 30 or 30A provided for one chamber 17 or 17A is referred to as X (%), there is obtained an equation of "X (%)=(A×B)×100/(Y×Z)". Also, the communicating hole 32 or 32A has a rectangular shape in this embodiment mode. However, needless to say, this hole may have any other shape such as an oval shape or a circular shape.

(First Embodiment)

Figure 10:
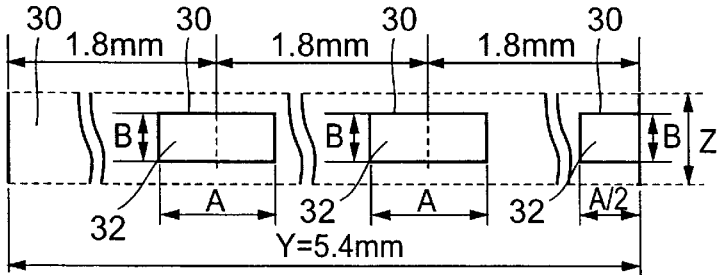
FIG. 10 is a plain view of a partitioning portion corresponding to one chamber of the head chip according to the first embodiment of the present invention.

FIG. 10 is a plain view of the partitioning portion 30 for one chamber of the head chip according to a first embodiment of the present invention.

As shown in the drawing, the head chip of the first embodiment has three communicating holes 32 established in the partitioning portion 30, with intervals between the communicating holes being set at 1.8 mm. The intervals between the communicating holes are set as the distances between the centers of respective communicating holes 32 and only the communicating hole 32 existing at one end on a side opposite to the nozzle opening in one end portion of the chamber in the longitudinal direction is set so as to have a size that is one-half the sizes of other communicating holes.

There are four head chips like this where the length of a chamber in the longitudinal direction is set as Y=5.4 mm and the sizes of the communicating holes are A×B=0.09 mm×0.06 mm, 0.18 mm×0.06 mm, 0.27 mm×0.06 mm, and 0.36 mm×0.06 mm, respectively.

(Second Embodiment)

Figure 11:
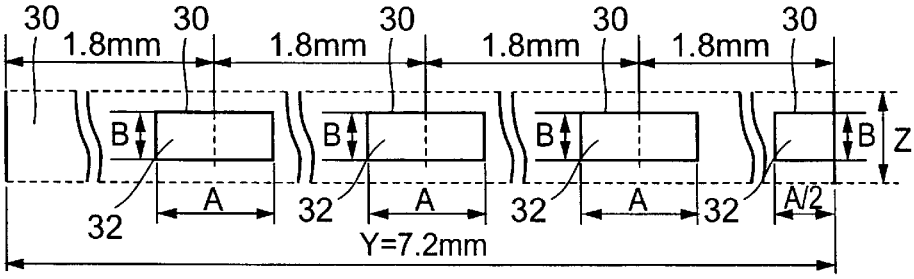
FIG. 11 is a plain view of a partitioning portion corresponding to one chamber of the head chip according to the second embodiment of the present invention.

FIG. 11 is a plain view of the partitioning portion 30 for one chamber of the head chip according to a second embodiment of the present invention.

As shown in the drawing, the head chip of the second embodiment has four communicating holes 32 established in the partitioning portion 30, with intervals between the communicating holes being set at 1.8 mm. The intervals between the communicating holes are set as the distances between the centers of respective communicating holes 32 and only the communicating hole 32 existing at one end on a side opposite to the nozzle opening in one end portion of the chamber in the longitudinal direction is set so as to have a size that is one-half the sizes of other communicating holes.

There are four head chips like this where the length of a chamber in the longitudinal direction is set as Y=7.2 mm and the sizes of the communicating holes are A×B=0.09 mm×0.06 mm, 0.18 mm×0.06 mm, 0.27 mm×0.06 mm, and 0.36 mm×0.06 mm, respectively.

(Third Embodiment)

Figure 12:
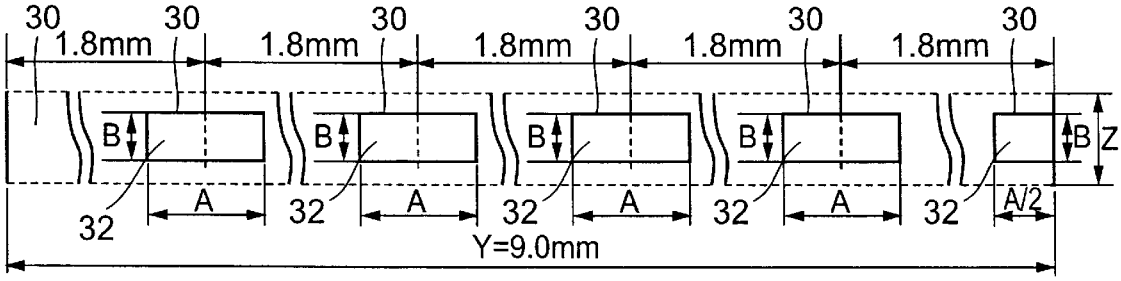
FIG. 12 is a plain view of a partitioning portion corresponding to one chamber of the head chip according to the third embodiment of the present invention.

FIG. 12 is a plain view of the partitioning portion 30 for one chamber of the head chip according to a third embodiment of the present invention.

As shown in the drawing, the head chip of the third embodiment has five communicating holes 32 established in the partitioning portion 30, with intervals between the communicating holes being set at 1.8 mm. The intervals between the communicating holes are set as the distances between the centers of respective communicating holes 32 and only the communicating hole 32 existing at one end on a side opposite to the nozzle opening in one end portion of the chamber in the longitudinal direction is set so as to have a size that is one-half the sizes of other communicating holes.

There are four head chips like this where the length of a chamber in the longitudinal direction is set as Y=9.0 mm and the sizes of the communicating holes are A×B=0.09 mm×0.06 mm, 0.18 mm×0.06 mm, 0.27 mm×0.06 mm, and 0.36 mm×0.06 mm, respectively.

EXPERIMENTAL EXAMPLE

The behavior of pressure in the nozzle opening 24 in the case where nozzle resistance is set at one of 40%, 60%, and 80% is measured for four kinds of head chips in the first embodiment, four kinds of head chips in the second embodiment, and four kinds of head chips in the third embodiment. During this measurement, a voltage is applied to the electrodes 19 so that a maximum displacement amount of both sidewalls 18 of the chamber 17 toward the outside with reference to the chamber becomes 0.01 $\mu$m and this state continues for 25$\mu$ second or longer. The width Z of the chamber 17 is set at 0.078 mm.

Further, there is extracted a pressure value after time AP, whose length is determined by the intervals between the communicating holes 32, has elapsed, and an opening ratio X (%), with which there is obtained a positive pressure value, of one communicating hole 32 to the area of the partitioning portion 30 occupied by one chamber 17 is obtained from the varying trend of the pressure value with reference to each nozzle resistance value in each embodiment. Here, the length of the time AP is the same and becomes 2.1$\mu$ second because every interval between the communicating holes is 1.8 mm. Also, if the pressure value after the time AP has elapsed is positive, this indicates that ink is correctly supplied.

Figure 13:
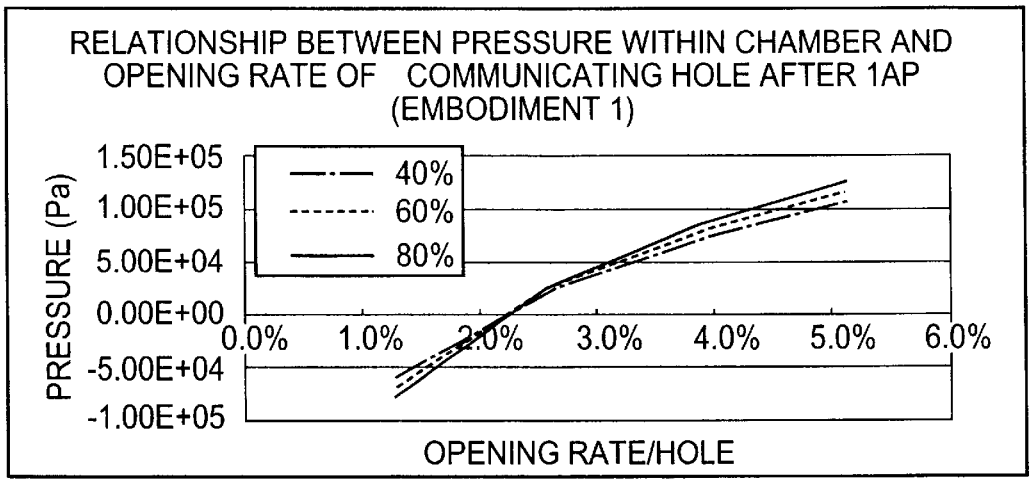
FIG. 13 is a graph in which pressure values obtained in the case of the first embodiment for respective communicating hole opening ratios after one AP has elapsed are distributed with reference to respective nozzle resistance values.

FIG. 13 shows a graph in which pressure values obtained for each communicating hole opening ratio in the case of the first embodiment after one AP has elapsed are distributed with reference to each nozzle resistance value.

Figure 14:
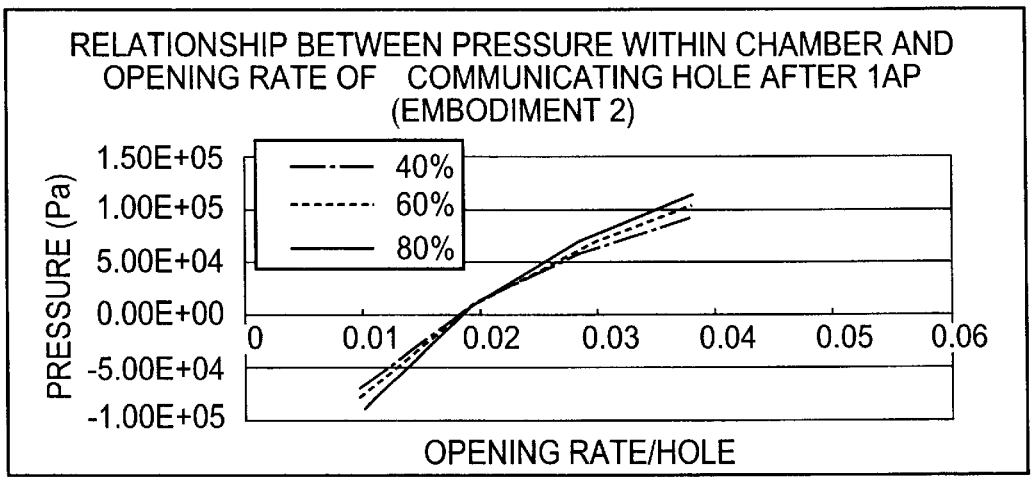
FIG. 14 is a graph in which pressure values obtained in the case of the second embodiment for respective communicating hole opening ratios after one AP has elapsed are distributed with reference to respective nozzle resistance values.

FIG. 14 shows a graph in which pressure values obtained for each communicating hole opening ratio in the case of the second embodiment after one AP has elapsed are distributed with reference to each nozzle resistance value.

Figure 15:
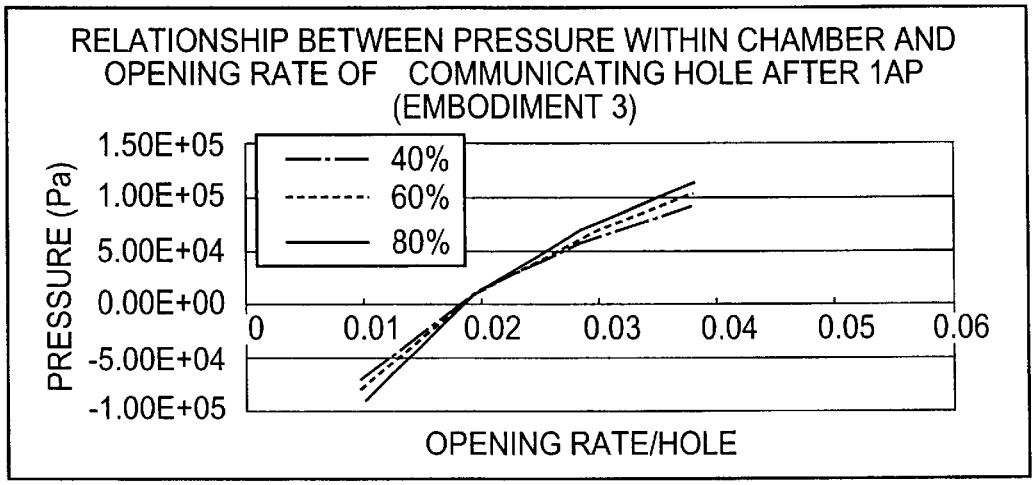
FIG. 15 is a graph in which pressure values obtained in the case of the third embodiment for respective communicating hole opening ratios after one AP has elapsed are distributed with reference to respective nozzle resistance values.
Figure 17:
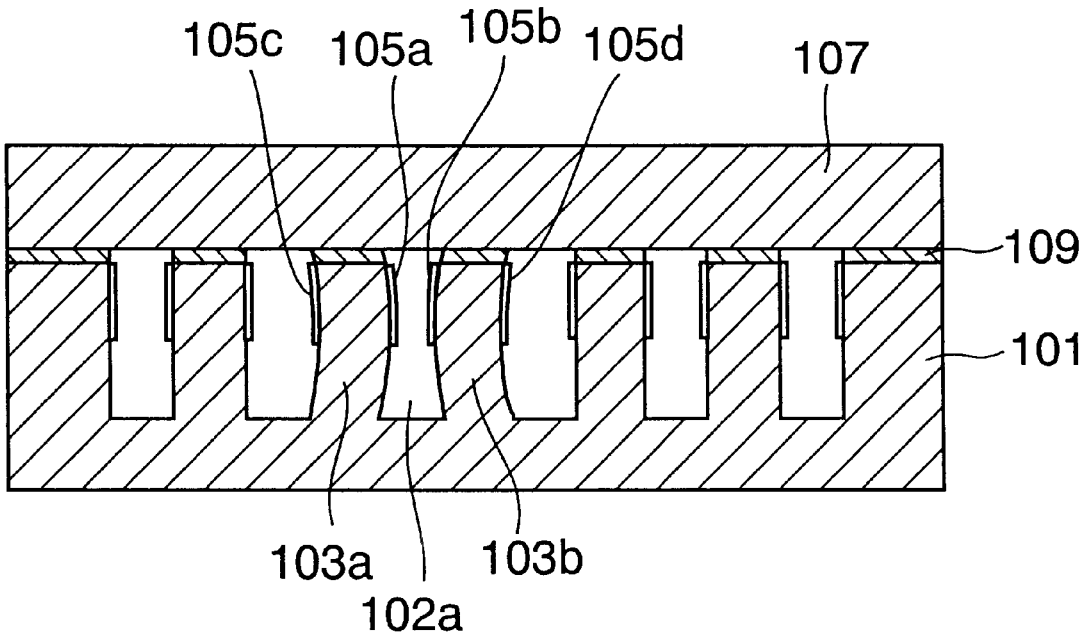
FIG.17 PRIOR ART
FIG. 17 is a sectional view showing the outline of the head chip according to the prior art.

FIG. 15 shows a graph in which pressure values obtained for each communicating hole opening ratio in the case of the third embodiment after one AP has elapsed are distributed with reference to each nozzle resistance value.

Table 1 shows values of the opening ratio X (%) read from FIGS. 13 to 15 described above, at which a positive pressure value is obtained in the nozzle opening 24 after the time AP has elapsed for each combination of the length of the chamber in the longitudinal direction and the nozzle resistance value.

TABLE 1

| | | Embodiment 1 | Embodiment 2 | Embodiment 3 |
|---|---|---|---|---|
| Chamber length Y (mm) | | 5.4 | 7.2 | 9.0 |
| | | Opening ratio X (%) of one communicating hole | | |
| Nozzle resistance | 40% | 2.20 | 1.80 | 1.45 |
| | 60% | 2.25 | 1.80 | 1.45 |
| | 80% | 2.30 | 1.85 | 1.50 |

If a relational expression between the chamber length Y (mm) and the opening ratio X (%) of one communicating hole is obtained from Table 1, there is obtained a relational expression of "Y=−4.5X+15.8". The value of X lead from the relational expression and the value of Y in all cases becomes larger than the opening ratio X (%) in Table 1 and the pressure in the chamber becomes positive at all times.

As can be seen from this, in the head chip of a model like the models shown in the first to third experimental examples, the expression described above determines the minimum area of one communicating hole where there occurs no shortage of ink supply.

As described above, with the technique of the present invention, in a head chip in which a plurality of communicating holes are provided in a partitioning portion so as to evenly divide the longitudinal direction of a chamber of the partitioning portion of a common ink chamber using a distance between a nozzle opening and the communicating hole that establishes communication between the common ink chamber and the chamber is provided in the partitioning portion at a position close to the nozzle opening, there is provided the communicating hole at one end on a side opposite to the nozzle opening in one end portion of the chamber in the longitudinal direction, and each of the plurality of communicating holes has the same opening ratio to the area of the partitioning portion, where if the length of the chamber in the longitudinal direction is referred to as Y (mm) and the opening ratio of one communicating hole to the area of the partitioning portion is referred to as X (%), by defining a relation of "Y=−4.5X+15.8" as the minimum size of the communicating hole, it becomes possible to sufficiently supply ink for discharging and to enhance the degree of sealing of a groove to a limit. As a result, it becomes possible to shorten a converging time, during which pressure in the chamber attenuates, to achieve high speed consecutive discharging, that is, to achieve high speed printing, and to stabilize printing quality.

What is claimed is:

1. A head chip comprising:

a substrate having a chamber for receiving ink, the chamber having an end portion and a pair of side walls;

a nozzle plate member connected to the substrate and having a nozzle opening communicating with the end portion of the chamber;

an electrode disposed on the side walls of the chamber and driven by a voltage signal to deform the side walls to vary the volume in the chamber to thereby eject ink from the chamber through the nozzle opening;

an ink chamber plate connected to the substrate and defining a common ink chamber for containing ink and disposed in communication with the chamber, the ink chamber plate having a partitioning portion for partitioning the chamber and the common ink chamber, the partitioning portion having a plurality of communicating holes arranged in a longitudinal direction of the chamber for communicating the common ink chamber with the chamber, an opening ratio of the area of each of the communication holes to an area of the ink chamber plate being the same, and a minimum area for each of the communication holes being obtained by the expression Y=−4.5X+15.8, where Y is a length of the chamber in the longitudinal direction thereof and X is the opening ratio.

2. A head chip according to claim 1; wherein the partitioning portion is formed separate from the ink chamber plate.

3. A head chip according to claim 1; wherein the substrate comprises a piezoelectric ceramic plate; and wherein the chamber comprises a groove formed in the piezoelectric ceramic plate.

4. A head chip according to claim 1; where in the side walls of the chamber are made of piezoelectric ceramic.

5. A head chip according to claim 4; where in the common ink chamber is formed in the substrate; and wherein the chamber and the common ink chamber communicate with each other at one end in the longitudinal direction of the chamber.

6. A head chip according to claim 1; wherein the ink chamber plate and the partitioning portion are formed from a single piece of material.

7. A head chip according to claim 1; further comprising a lid connected to the ink chamber plate for sealing an open end of the common ink chamber.

8. A head chip according to claim 1; further comprising a sealing plate connected to the substrate for sealing an open end of the chamber.

9. A head chip according to claim 1; wherein the common ink chamber comprises a first ink chamber; and further comprising a first sealing plate connected to the substrate and a second sealing plate connected to the substrate to define a second ink chamber disposed between the first and second sealing plates, the second ink chamber being disposed in communication with the chamber through a communication hole of the first sealing plate.

10. A head chip according to claim 9; wherein the first ink chamber communicates with the second ink chamber through one of the communication holes of the partitioning portion.

11. A head chip comprising:

a substrate having a plurality of first partition walls spaced apart at a preselected interval to form a plurality of channels each for receiving ink and having a preselected length and a pair of side walls;

a plurality of electrodes connected to the side walls of the channels and driven by a voltage signal to deform the side walls to vary the volume in the channels to thereby eject ink from the channels;

an ink chamber plate connected to the substrate; and a partitioning member connected to the ink chamber plate to define an ink chamber for containing ink, the partitioning member having a plurality of communicating holes for communicating the ink chamber with the channels, an opening ratio of the area of each of the communication holes to an area of the ink chamber plate being the same, and a minimum area for each of the communication holes being in accordance with the expression Y=−4.5X+15.8, where Y is the preselected length of the channels and X is the opening ratio.

12. A head chip according to claim 11; wherein the partitioning member is formed separate from the ink chamber plate.

13. A head chip according to claim 11; wherein the partitioning member and the ink chamber plate are formed from a single piece of material.

14. A head chip according to claim 11; wherein the substrate comprises a piezoelectric ceramic plate.

15. A head chip according to claim 11; wherein the side walls of the channels are made of piezoelectric ceramic.

16. A head chip according to claim 11; further comprising a sealing plate connected to the ink chamber plate for sealing an open end of the ink chamber.

17. A head chip according to claim 11; further comprising a sealing plate connected to the substrate for sealing an open end of each of the channels.

18. A head chip according to claim 11; wherein the ink chamber comprises a first ink chamber; and further comprising a first sealing plate connected to the substrate and a second sealing plate connected to the substrate to define a second ink chamber disposed between the first and second sealing plates, the second ink chamber being disposed in communication with the channels through a communication hole of the first sealing plate.

19. A head chip according to claim 18; wherein the first ink chamber communicates with the second ink chamber through one of the communication holes of the partitioning portion.

20. A head chip according to claim 11; further comprising a nozzle plate member connected to the substrate and having a plurality of nozzle openings each communicating with a respective one of the channels so that when the electrodes are driven by a voltage signal ink is ejected from the channels through the nozzle openings.

21. A head chip according to claim 1; wherein each of the communicating holes has a generally circular cross-sectional shape.

22. A head chip according to claim 1; wherein each of the communicating holes has a generally oval cross-sectional shape.

23. A head chip according to claim 1; wherein each of the communicating holes has a generally rectangular cross-sectional shape.

24. A head chip according to claim 1; wherein the plurality of communicating holes of the partitioning portion are disposed in communication with one another to define a communicating passage; and wherein a relation between a quantity $S_{min}$ corresponding to the area of each of the communicating holes satisfying the equation Y=−4.5X+15.8 and a quantity $S_{max}$ corresponding to a length of the communicating passage is in accordance with the expression $S_{min}<S_{max}$.

25. A head chip according to claim 11; wherein each of the communicating holes has a generally circular cross-sectional shape.

26. A head chip according to claim 11; wherein each of the communicating holes has a generally oval cross-sectional shape.

27. A head chip according to claim 11; wherein each of the communicating holes has a generally rectangular cross-sectional shape.

28. A head chip according to claim 11; wherein the plurality of communicating holes of the partitioning portion are disposed in communication with one another to define a communicating passage; and wherein a relation between a guantity $S_{min}$ corresponding to the area of each of the communicating holes satisfying the equation Y=−4.5X+15.8 and a quantity $S_{max}$ corresponding to a length of the communicating passage is in accordance with the expression $S_{min<Smax}$.

* * * * *